US007734197B2

(12) United States Patent
Sato

(10) Patent No.: US 7,734,197 B2
(45) Date of Patent: Jun. 8, 2010

(54) TONER CARTRIDGE HAVING PROTRUSION TO SHOW TYPE OF TONER CARTRIDGE

(75) Inventor: Tsutomu Sato, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 201 days.

(21) Appl. No.: 11/749,275

(22) Filed: May 16, 2007

(65) Prior Publication Data

US 2007/0269224 A1 Nov. 22, 2007

(30) Foreign Application Priority Data

May 18, 2006 (JP) ..... 2006-139187

(51) Int. Cl.
*G03G 15/00* (2006.01)
*G03G 15/08* (2006.01)

(52) U.S. Cl. ..... 399/12; 399/262

(58) Field of Classification Search ..... 399/12, 399/110, 111, 120, 13, 262; 347/49, 86
See application file for complete search history.

(56) References Cited

U.S. PATENT DOCUMENTS

| | | | | |
|---|---|---|---|---|
| 4,740,808 | A * | 4/1988 | Kasamura et al. | 399/12 |
| 4,949,123 | A * | 8/1990 | Takashima | 399/12 |
| 2002/0094208 | A1 * | 7/2002 | Palumbo | 399/12 |
| 2005/0105922 | A1 * | 5/2005 | Kawai | 399/12 |
| 2007/0189781 | A1 * | 8/2007 | Katogi et al. | 399/12 |
| 2008/0025735 | A1 * | 1/2008 | Odani | 399/12 |

FOREIGN PATENT DOCUMENTS

JP 2006-030569 2/2006

* cited by examiner

*Primary Examiner*—Sophia S Chen
(74) *Attorney, Agent, or Firm*—Turocy & Watson, LLP

(57) ABSTRACT

A toner cartridge inserted in an image forming apparatus and supplying toner to the image forming apparatus, the cartridge contains a toner container that contains toner, and a protrusion for showing a type of the toner cartridge, wherein the protrusion forms a ramp inclining toward a direction the toner cartridge is inserted in the image forming apparatus.

18 Claims, 12 Drawing Sheets

TONER CARTRIDGE HAVING PROTRUSION TO SHOW TYPE OF TONER CARTRIDGE

CROSS-REFERENCE TO RELATED APPLICATIONS

This application is based upon and claims the benefit of priority from prior Japanese Patent Application No. 2006-139187, filed May 18, 2006, the entire contents of which are incorporated herein by reference.

BACKGROUND OF THE INVENTION

1. Field of the Invention

The present invention relates to a toner cartridge for supplying toner to an image forming apparatus.

2. Description of the Related Art

An image forming apparatus has a toner cartridge, for supplying toner to the apparatus. The toner cartridge is inserted in the image forming apparatus in a mountable and removable manner. Also, the toner cartridge is configured such that the user can exchange the toner cartridge himself or herself when the toner cartridge is emptied of toner. In addition, a filling opening is provided in the toner cartridge and the toner is supplied through the filling opening. In the toner cartridge, a mixer is rotated constantly so as to prevent the toner from solidifying inside the toner cartridge.

The toner cartridge needs to be inserted into a predetermined place of the image forming apparatus with respect to four colors, i.e. yellow, magenta, cyan, and black. In addition, the toner cartridge is classified by destination countries. For this reason, Jpn. Pat. Appln. Publication No. 2006-30569 discloses a toner cartridge in which protrusions are provided and a shape and the number of the protrusions are varied depending on the destination countries.

The toner cartridge is configured such that, when the toner cartridge having the protrusions with the shape and the number thereof varied depending on the destination countries is inserted into the image forming apparatus, the toner cartridge cannot be inserted into a place other than the predetermined place due to the protrusions.

However, even if the shape and the number of protrusions are varied depending on the destination countries, there is a case in which a main body frame of the image forming apparatus bends and the cartridge is inserted in error when strength of the main body frame is low. Despite the above, no measures in case of the insertion in error is suggested in the conventional art.

The present invention is invented in view of the above circumstances. An object of the present invention is to provide a user-friendly toner cartridge which can be easily pulled out from the image forming apparatus.

BRIEF SUMMARY OF THE INVENTION

According to one aspect of the present invention, there is provided a toner cartridge comprising: a toner container that contains toner and a protrusion for showing a type of the toner cartridge, wherein the protrusion forms a ramp inclining toward a direction the toner cartridge is inserted in the image forming apparatus.

DETAILED DESCRIPTION OF THE INVENTION

Hereinafter, a preferred embodiment for carrying out the present invention will be described.

Figure 1:
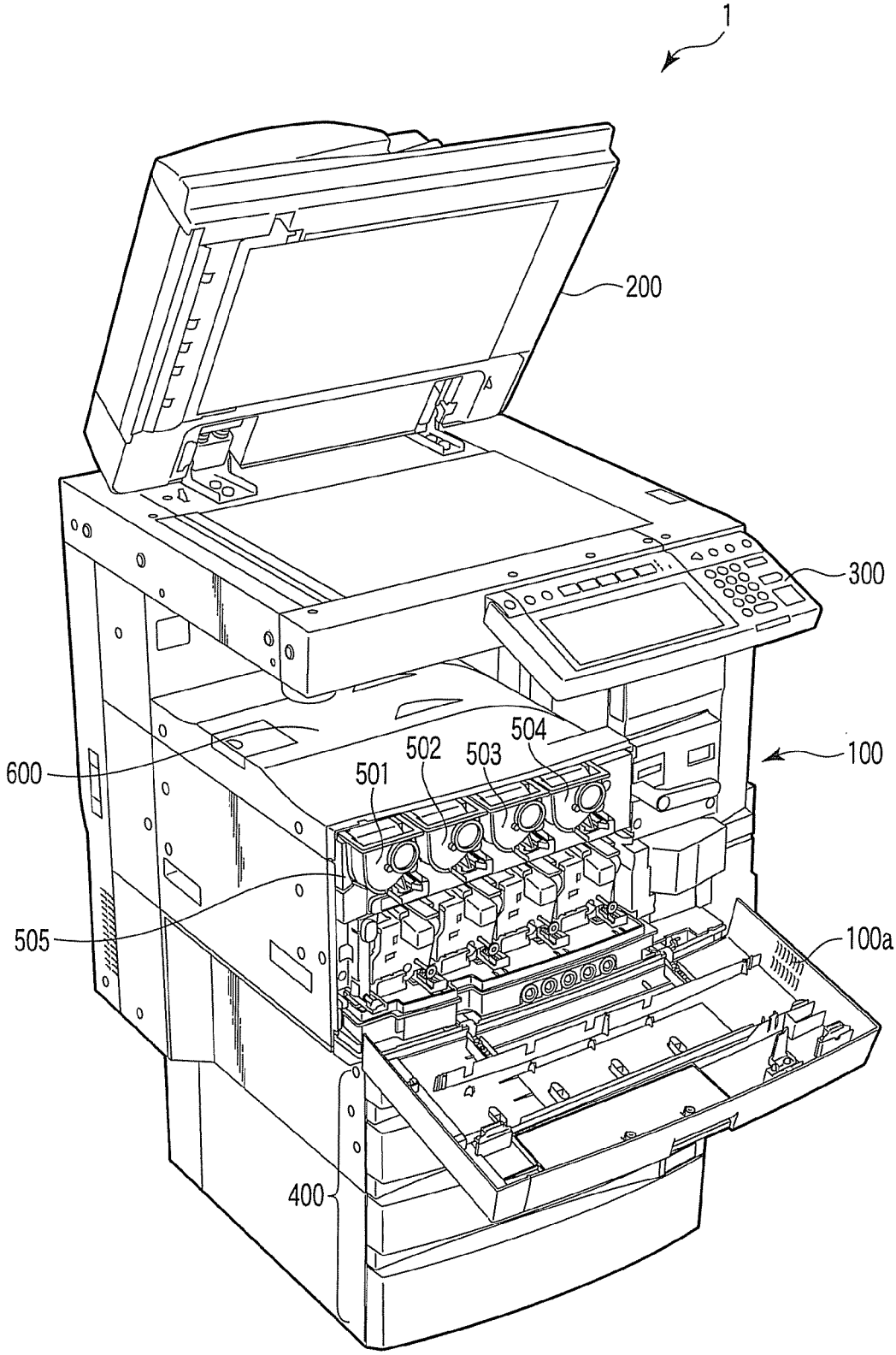
FIG. 1 is a schematic view showing an internal structure of an image forming apparatus according to one embodiment of the present invention.

FIG. 1 is a perspective view of a schematic view showing an internal structure of an image forming apparatus 1 according to an embodiment of the present invention. As shown in FIG. 1, the image forming apparatus 1 is a color copier of a quadruple tandem system. The image forming apparatus 1 includes a copier main body 100, a platen cover 200, a control panel 300, and a plurality of paper feeding cassettes 400.

The copier main body 100 plays a major role in image forming, and has a cover 100*a* provided on a front surface thereof in an openable and closable manner. When the cover 100*a* is opened, first to fourth toner cartridges 501 to 504 are found to be arranged in alignment on an upper portion side of the cover 100*a*. The platen cover 200 is provided on the copier main body 100 in an rotatable manner with one side edge as a rotational center. The control panel 300 is an input unit for copy operation and is provided on a top surface of the copier main body 100. The paper feeding cassette 400 is for containing paper and is provided on a lower side of the copier main body 100 in a removable manner. In addition, a paper delivering unit 600 is provided on top of a portion where the first to fourth toner cartridges 501 to 504 are provided.

Each of the first to fourth toner cartridges 501 to 504 is provided in a removable manner in a cartridge holding mechanism 505. The first to fourth toner cartridges 501 to 504 are for supplying toner of yellow, magenta, cyan, and black.

Next, a configuration of the first toner cartridge 501 will be described with reference to FIG. 2. Description of configurations of the second to fourth toner cartridges 502 to 504 will be omitted, since such configurations are almost same as the configuration of the first toner cartridge 501.

Figure 2:
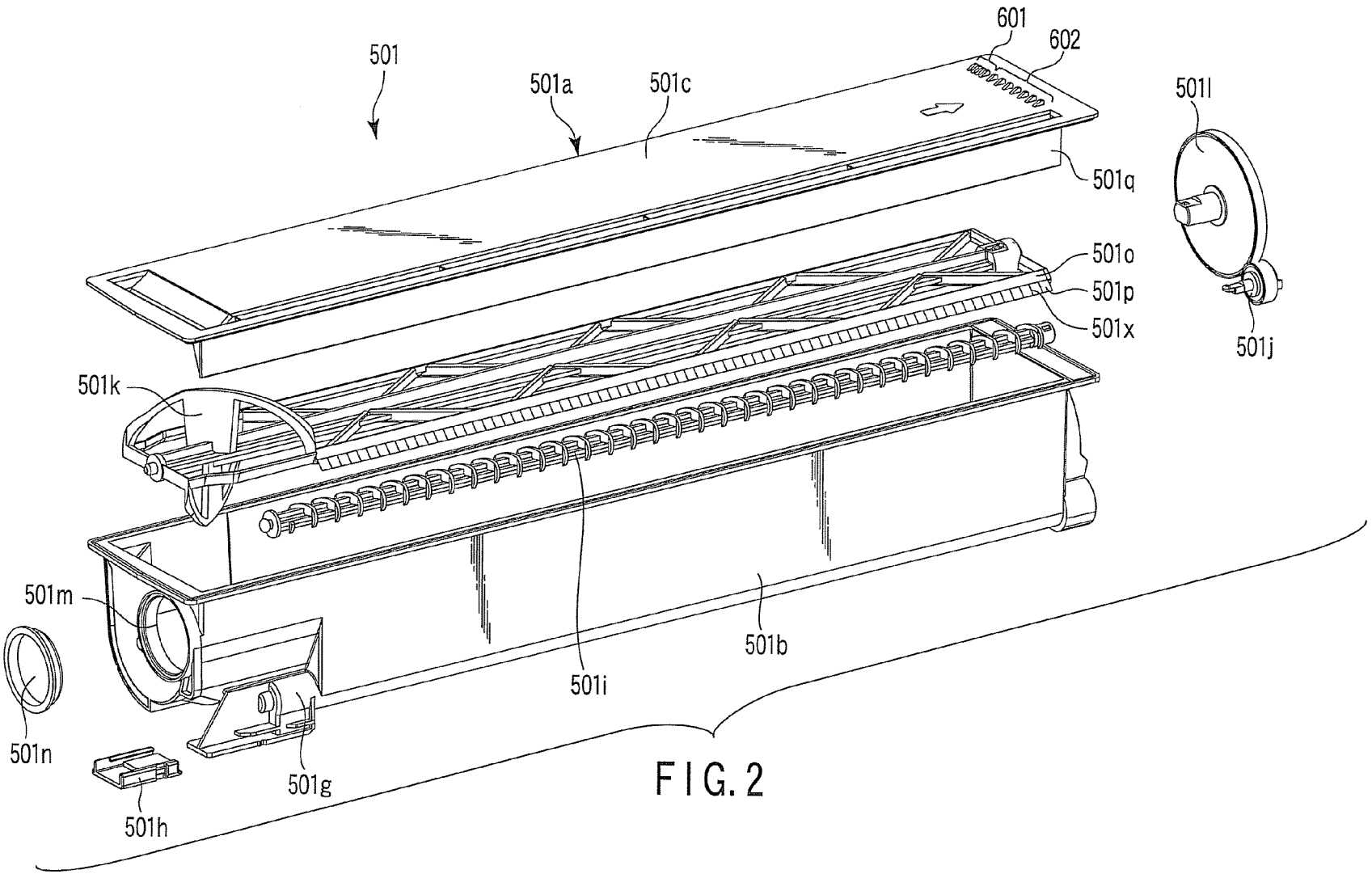
FIG. 2 is a perspective view showing a toner cartridge according to the present embodiment viewed from above a front side.

FIG. 2 is a perspective view showing an entire configuration of the first toner cartridge 501 according to the present embodiment viewed from a front surface side. Here, a surface with a cap 501*n* of the first toner cartridge 501 is the front surface side, and a surface with a mixer gear 501*l* is a rear side.

As shown in FIG. 2, the first toner cartridge 501 includes a cartridge main body 501*a* working as a toner container for containing the toner. The cartridge main body 501*a* is configured with a container body 501*b* and a lid body 501*c*. Also, first and second discriminating protrusion units 601 and 602 for discriminating toner information are provided on a rear side of the cartridge main body 501*a*. The first and the second discriminating protrusion units 601 and 602 are important points of the present invention, and will be described more in detail later.

The container body 501*b* has a U-shaped cross section. The lid body 501*c* has a rectangular plate shape. On a front surface side of the container body 501*b*, there is provided a discharging unit 501*g* which discharges the toner in the cartridge main body 501*a* and works as a toner supplying opening for supplying the toner in the image forming apparatus 1. The discharging unit 501*g* projects downwardly from a bottom surface of the container body 501*b*. On a bottom edge part of the discharging unit 501*g*, there is provided a shutter 501*h* for opening and closing a discharging opening (not shown) formed on the discharging unit 501*g*.

Figure 6:
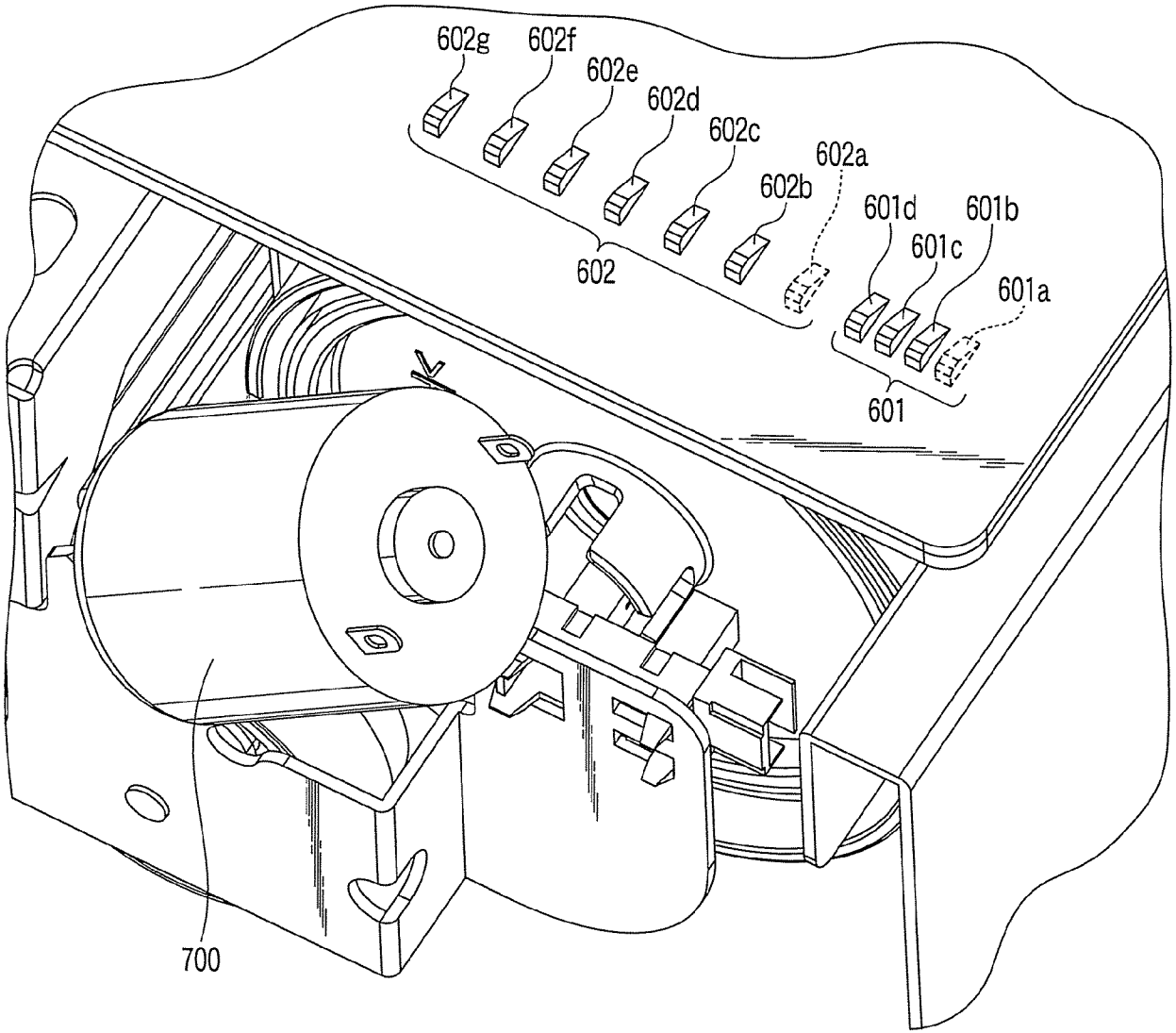
FIG. 6 is an enlarged perspective view of the toner cartridge according to the present embodiment viewed from above a rear side.
Figure 7A:
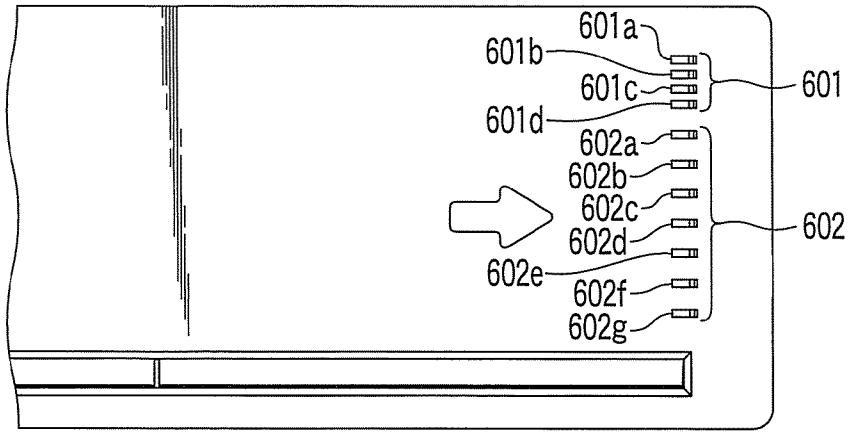
FIG. 7A is a plan view showing the toner cartridge according to the present embodiment viewed from above.
Figure 7B:
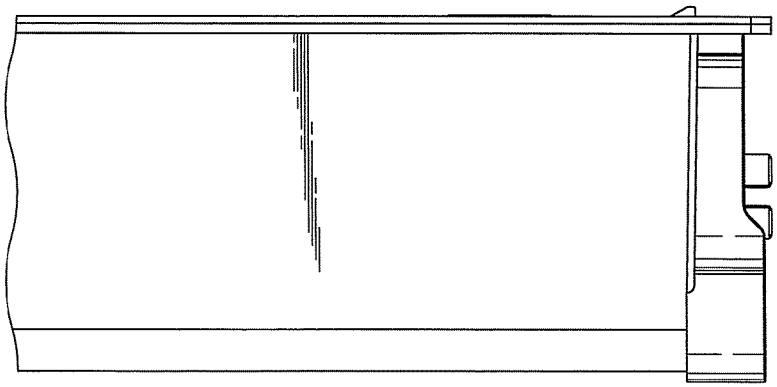
FIG. 7B is a side view showing the toner cartridge according to the present embodiment viewed from a side.
Figure 7C:
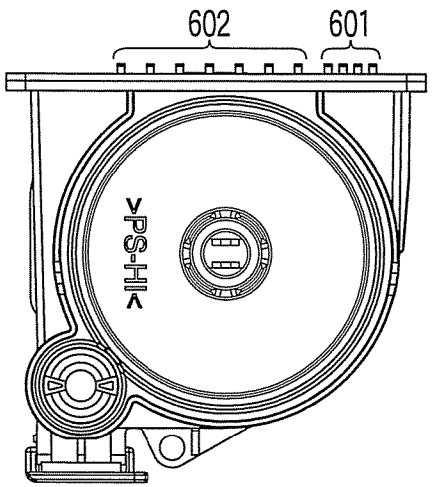
FIG. 7C is a plan view showing the toner cartridge according to the present embodiment viewed from a rear side.

At the inner bottom of the containing unit 501*b*, there is provided a screw 501*i* working as a conveying member for conveying the toner in the cartridge main body 501*a* to the discharging unit 501*g*. On an end part on a rear surface side of the screw 501*i*, there is provided a coupling member 501*j* working as a driving member. The coupling member 501*j* is connected to a driving apparatus 700 shown in FIG. 6 provided in the copier main body 100, and rotationally driven every time the toner is supplied.

Inside the cartridge main body 501*a*, there is provided a mixer 501*k* for agitating the toner in the cartridge main body 501*a*. At an end part on a rear surface of the mixer 501*k*, there is provided a mixer gear 501*l*. The mixer gear 501*l* meshes with the coupling member 501*j* working as a gear provided in the screw 501*i*. When the screw 501*i* is rotated, the mixer gear 501*k* is configured to rotate in association therewith.

On a front surface side of the container body 501*b*, there is formed a filling opening 501*m* used for filling the toner in the cartridge main body 501*a*. The filling opening 501*m* has a circular shape, and is sealed with the cap 501*n*.

Figure 3:
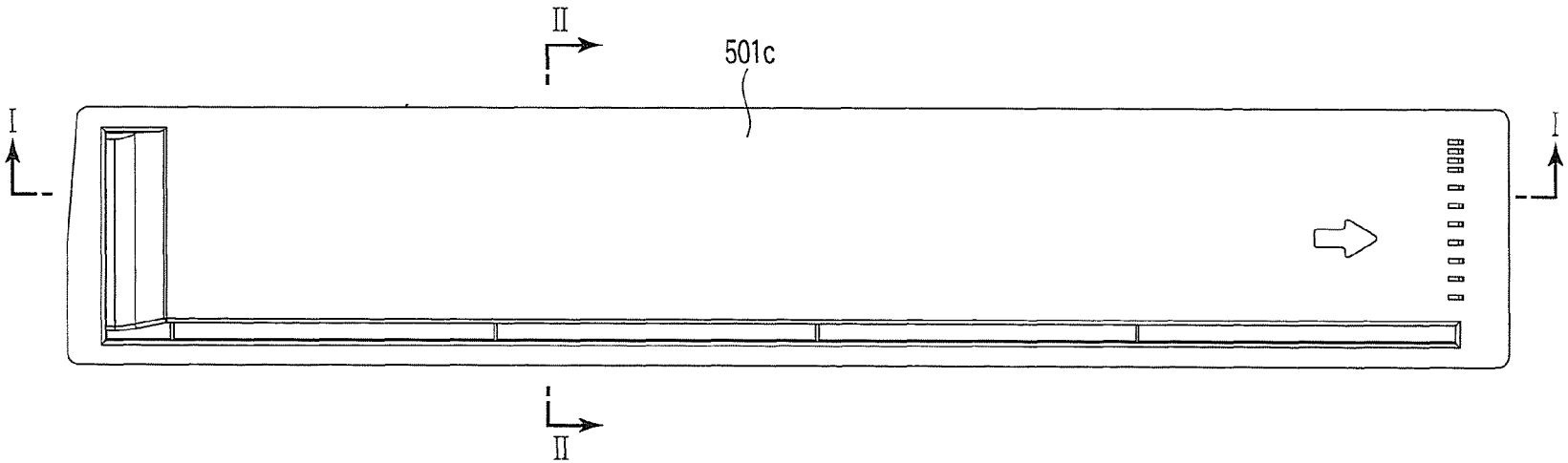
FIG. 3 is a plan view showing the toner cartridge according to the present embodiment viewed from above.
Figure 4:
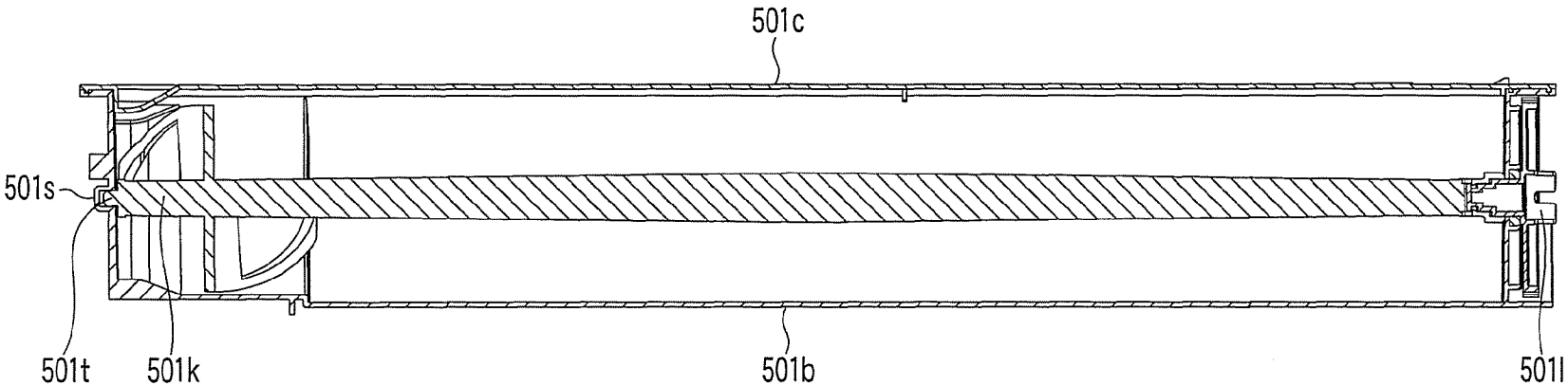
FIG. 4 is a transverse cross-sectional view showing an internal structure of the toner cartridge according to the present embodiment.

FIG. 3 is a view of the first toner cartridge 501 viewed from above a top surface. In addition, FIG. 4 shows a cross-sectional view of the first toner cartridge 501 cut along the line I-I in FIG. 3. The mixer 501*k* is fixed as described below. On a rear side surface of the first toner cartridge 501, the mixer 501*k* connects with the mixer gear 501*l* with a coupling unit interposed therebetween. In addition, on a front surface side of the first toner cartridge 501, the mixer 501*k* has a convex part 501*t* formed in a convex shape at an end part, and fits in a concave part 501*s* provided on a front surface side of the container body.

Here, an inner diameter of the concave part 501*s* is little larger than an outer diameter of the convex part 501*t*. For this reason, when the mixer 501*k* rotates to agitate the toner, the toner enters into a little gap between the convex part 501*t* and the concave part 501*s*. In this manner, friction between the convex part 501*t* and the concave part 501*s* is reduced, and the mixer 501*k* can rotate smoothly.

Figure 5:
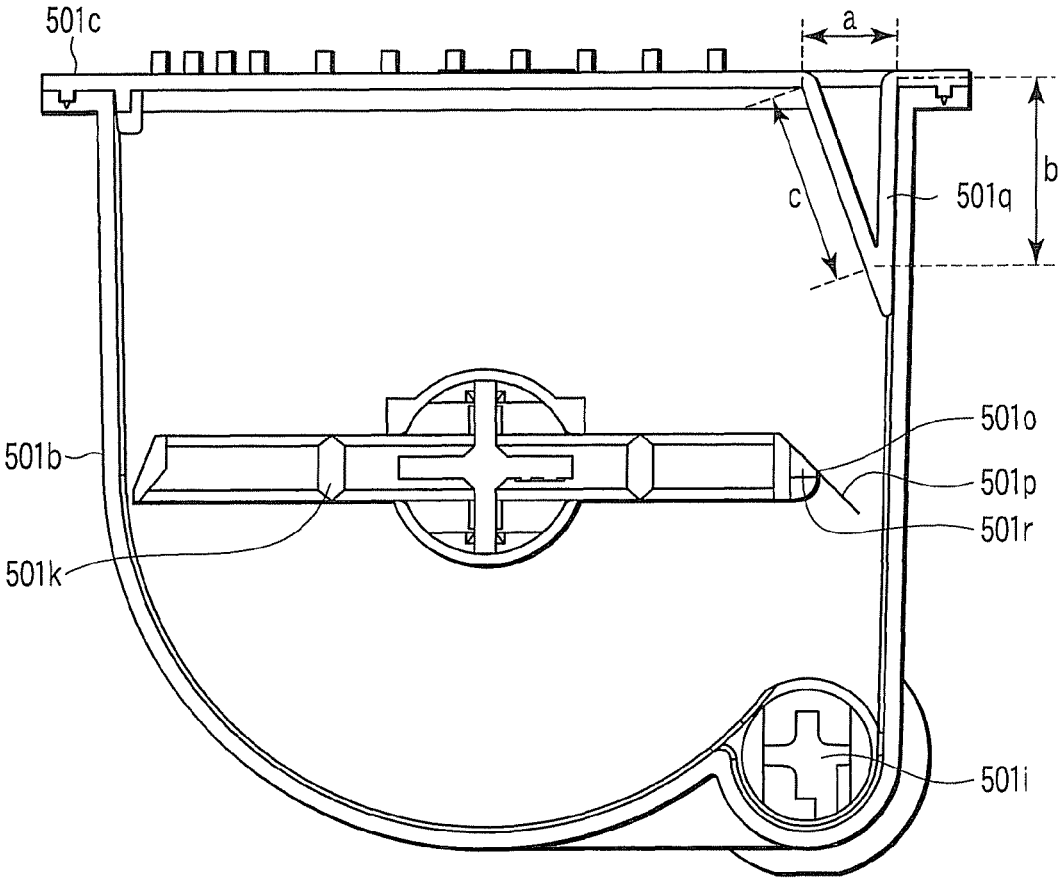
FIG. 5 is a vertical cross-sectional view showing the internal structure of the toner cartridge according to the present embodiment.

FIG. 5 shows a cross-sectional view of the first toner cartridge 501 cut along the line II-II in FIG. 3. The lid body 501*c* has a lid body protrusion part 501*q*. The lid body protrusion part 501*q* is provided at an upper edge of the container body 501*b* when the lid body 501*c* is inserted in the container body 501*b*. The lid body protrusion part 501*q* is a protrusion having a cross-sectional triangle shape enclosed by a line a, a line b, and an oblique line c. The line a has a predetermined length in a width direction from a connection of the lid body 501*c* and the container body 501*b*. The line b has a predetermined length from the connection of the lid body 501*c* and the container body 501*b* to the container body 501*b* and crosses the line a at a substantial right angle. The oblique line c is determined by the above two sides.

In addition, a surface enclosed by the line b having a predetermined length of the lid body protrusion part 501*q* and a longitudinal direction of the lid body 501*c* is formed such that the lid body 501*c* abuts the container body 501*b* without having any gap interposed therebetween when the lid body 501*c* is inserted in the container body 501*b*.

When the amount of the toner in the toner cartridge main body 501*a* becomes little, a gap appears between an outer periphery of the mixer 501*k* and an inner wall of the container body 501*b*. Therefore, the toner remaining in the gap cannot be conveyed by the mixer 501*k*. However, in the present embodiment, the lid body protrusion part 501*q* fills the gap appearing in the connection of the container body 501*b* and the lid body 501*c*. Therefore, the toner can be prevented from remaining in the gap.

Further, the lid body protrusion part 501*q* is provided with a surface having the oblique line c. Therefore, the toner adhered to the lid body protrusion part 501*q* easily flows down to an inside bottom of the container body 501*b*, and adherence of the toner hardly occurs.

In addition, as shown in FIG. 5, a sweep sheet 501*o* is fixed on a mounting surface 501*r* which is an outer periphery part of the mixer 501*k*. In addition, a sweep part 501*p*, which is a free end not fixed on the mounting surface 501*r* of the sweep sheet 501*o*, projects in a further extended direction from an outer periphery part of the mixer 501*k*. The mixer 501*k* rotates counterclockwise in FIG. 5 which is a cross-sectional view of the first toner cartridge 501 viewed from a front surface side. For this reason, the sweep part 501*p* abuts the inner bottom of the container body 501*b*.

Further, as shown in FIG. 2, on the mounting surface 501*r* of the mixer 501*k*, there is inserted the sweep sheet 501*o* in a longitudinal direction. In addition, a plurality of cut parts 501*x* shown in FIG. 2 are formed on the sweep sheet 501*o* with predetermined intervals for an overall length in a width direction in a direction substantially parallel to a rotational axis.

When a driving force is transmitted from the driving apparatus 700 shown in FIG. 6 to rotationally drive the coupling member 501*j*, the screw 501*i* is rotationally driven in an integrated manner, and the mixer 501*k* is rotationally driven via the mixer gear 501*l*. In this manner, the mixer 501*k* agitates and sends out the toner to the screw 501*i* at the same time. The screw 501*i* conveys the sent-out toner to the discharging unit 501*g*. Then, the toner is discharged from the discharging unit 501*g*. When the first toner cartridge 501 just starts to be used, the toner amount in the container body 501*b* is large. Even when the mixer 501*k* and the sweep sheet 501*o* rotate in an integrated manner, the toner in contact with the sweep part 501*p* passes through the cut parts 501*x* and flows toward a rear direction of the sweep part 501*p*. Therefore, the sweep sheet 501*o* never interferes with the rotation of the mixer 501*k*.

In addition, when the toner amount of the first toner cartridge 501 becomes small, a gap is formed between the outer periphery part of the mixer 501*k* and the inner wall of the container body 501*b*. Therefore, the toner remaining in the gap cannot be conveyed by the mixer 501*k*. However, the sweep sheet 501*o* abuts the inner bottom of the container body 501*b*. Therefore, the toner remaining in the gap can be sent out to the screw 501*i*. In this way, an amount of the remaining toner in the first toner cartridge 501 can be reduced.

Next, the first and the second discriminating protrusion units 601 and 602 which are important parts of the present embodiment will be described by using FIGS. 6 to 10C.

Figure 8A:
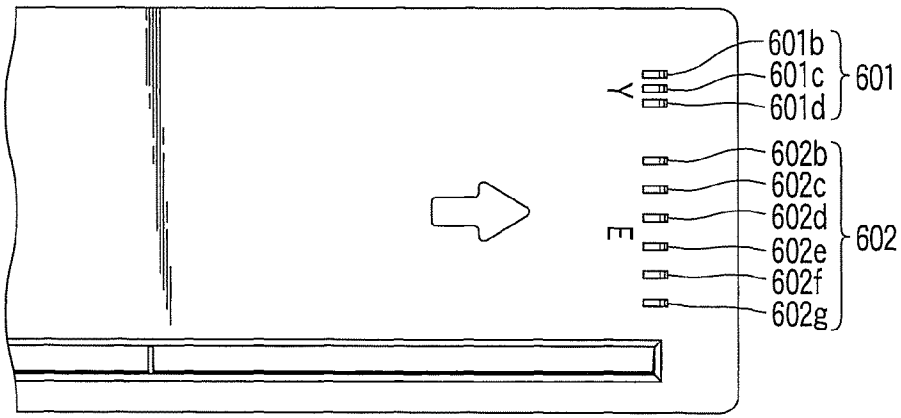
FIG. 8A is a plan view showing the toner cartridge according to the present embodiment viewed from above.
Figure 8B:
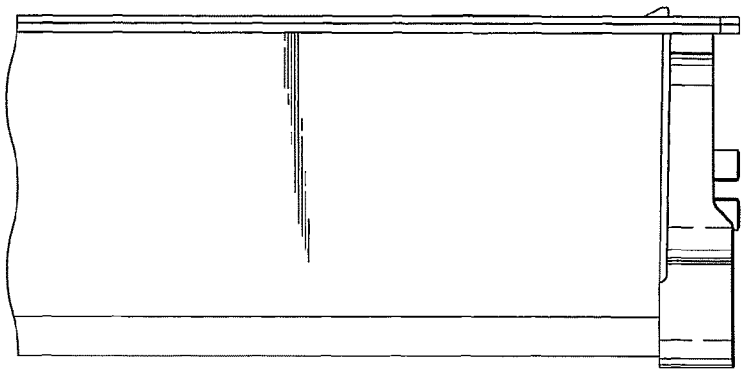
FIG. 8B is a side view showing the toner cartridge according to the present embodiment viewed from a side.
Figure 8C:
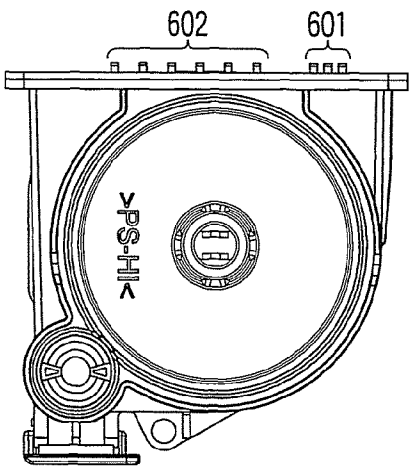
FIG. 8C is a plan view showing the toner cartridge according to the present embodiment viewed from a rear side.

FIGS. 6, 7A, 7B and 7C are configured for describing the first and the second discriminating protrusion units 601 and 602 according to the present embodiment. In reality, the first toner cartridge 501 shown in FIGS. 6, 7A, 7B and 7C does not exist. FIGS. 8A, 8B, and 8C show the first toner cartridge 501 used for yellow toner and delivered to Europe according to the present embodiment. FIGS. 8A, 8B, and 8C are a top view, a side view, and a rear side view, respectively.

The first and the second discriminating protrusion units 601 and 602 are provided on the lid body 501*c* and on a rear surface side of the first toner cartridge 501. In FIGS. 8A, 8B and 8C, as to the first discriminating protrusion unit 601, three protrusions 601*b*, 601*c*, and 601*d* are configured on the right side on the lid body 501*c*, for example, with predetermined intervals in a width direction when the first toner cartridge 501 is viewed from a rear surface side.

The second discriminating protrusion unit 602 is configured with, for example, six protrusions 602*b*, 602*c*, 602*d*, 602*e*, 602*f*, and 602*g*, with predetermined intervals in a width direction on a left side of the first discriminating protrusion unit 601. In other words, one without protrusions 601*a* and 602*a* shown in FIGS. 6, 7A, 7B and 7C is the first toner cartridge 501 used for the yellow toner and delivered to Europe.

Figure 9:
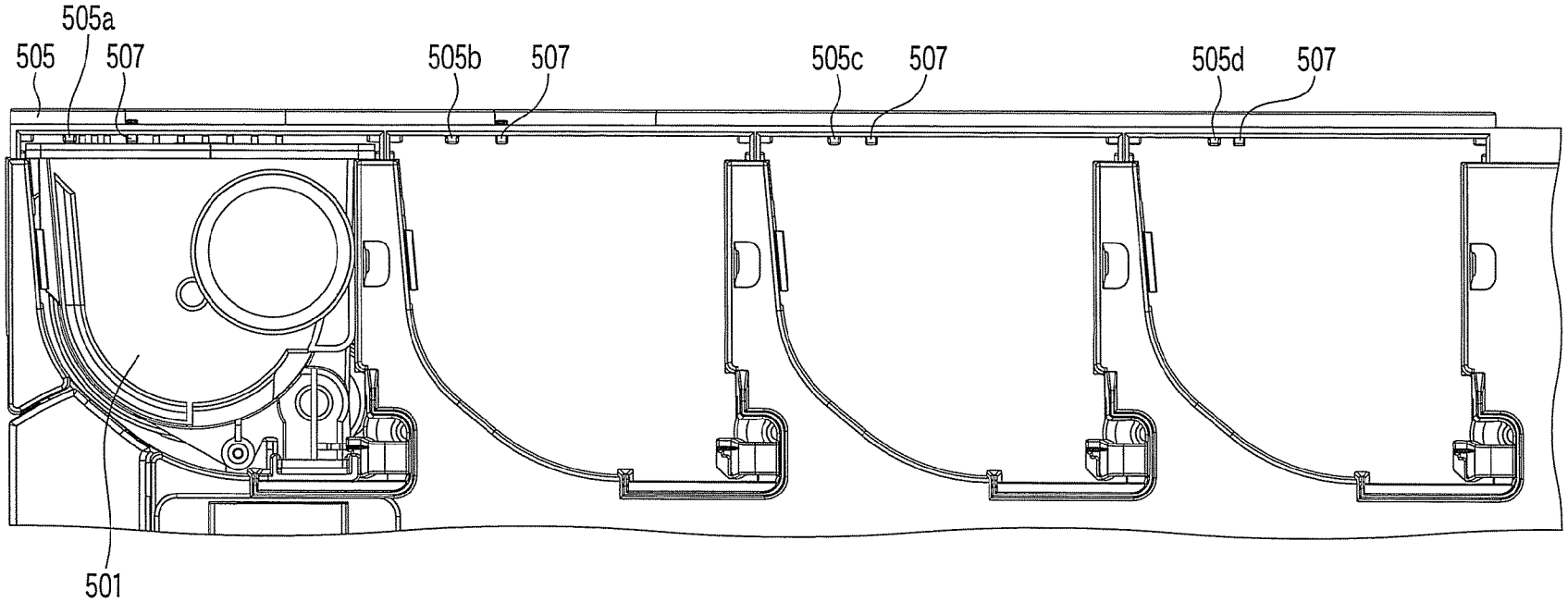
FIG. 9 is a front view showing the toner cartridge and a cartridge holding mechanism according to the present embodiment viewed from a front.

Next, a method of discriminating information shown by the discriminating protrusion units 601 and 602 on a side of the copier main body 100 will be described. As shown in FIG. 9, on the side of the copier main body 100, there are provided protrusions 505*a* and 507. The protrusions 505*a* and 507 have a size and are positioned so as to collide with the protrusions 601*a* and 602*a*, if there are the protrusions 601*a* and 602*a*, when the first toner cartridge 501 is inserted into the copier main body 100. The protrusions 601*a* and 602*a* do not exist in the actual first toner cartridge 501. Therefore, the first toner cartridge 501 is inserted in the copier main body 100 without having its insertion being interfered with by the protrusions 505*a* and 507.

On the other hand, in a case of the second toner cartridge 502 of magenta which is delivered to Europe, the protrusion 601*b* is removed from the first discriminating protrusion unit 601 in FIGS. 6, 7A, 7B and 7C, and the protrusions 601*a*, 601*c*, and 601*d* exist. The second discriminating protrusion unit 602 has the same shape as the one described above. For this reason, when the second toner cartridge 502 of magenta attempts to be inserted into the copier main body 100, the insertion of the second toner cartridge 502 into the copier main body 100 is interfered with by the protrusion 601*a* coming into contact with the protrusion 505*a*.

As described above, the first discriminating protrusion unit 601 is configured such that any of the protrusions 601*a*, 601*b*, 601*c* and 601*d* on the cartridge side is removed depending on which of the colors of yellow, magenta, cyan, and black the cartridge is for. Also, protrusions 505*a* to 505*d* are provided on the side of the copier main body 100 in a manner corresponding to the above removal of the protrusion in 1:1 ratio. In this manner, the first to the fourth toner cartridges 501 to 504 having a correct color are inserted into the main body.

In addition, the cartridge holding mechanism 505 is arranged on a front surface of the copier main body 100. Moreover, the second discriminating protrusion unit 602 is provided on a rear surface side of the first toner cartridge 501. For this reason, insertion in error can be detected without inserting the first toner cartridge 501 deep inside the copier main body 100.

The second discriminating protrusion unit 602 is used in the present embodiment to show an area the image forming apparatus 1 is used, that is, a delivery destination such as the US and Europe. A discriminating method of the second discriminating protrusion unit 602 is similar to that of the first discriminating protrusion unit 601.

Color discrimination and destination discrimination of the toner in the cartridge main body 501*a* are carried out by using the first and the second discriminating protrusion units 601 and 602 in the present embodiment. However, the present invention is not limited thereto. For example, the toner amount in the cartridge main body 501*a* may be discriminated by using a third discriminating protrusion unit.

In addition, on the lid body 501*c*, there are marks (Y indicating yellow and E indicating Europe as shown in FIGS. 8A, 8B and 8C) showing the toner information shown by arrangements of the first and the second discriminating protrusion units 601 and 602. For this reason, even if there are many kinds of toner cartridges, a color and a destination of the toner become apparent. Therefore, a workload of exchanging the first toner cartridge 501 can be reduced.

Figure 10A:
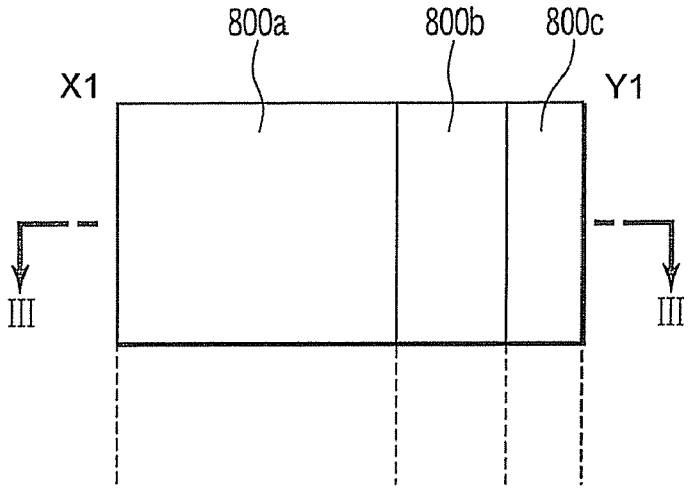
FIG. 10A is a plan view showing a protrusion according to the present embodiment viewed from above.
Figure 10B:
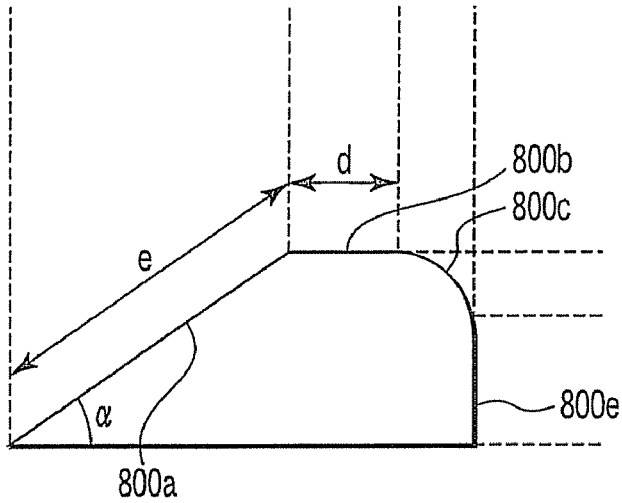
FIG. 10B is a side view showing the protrusion according to the present embodiment viewed from a side.
Figure 10C:
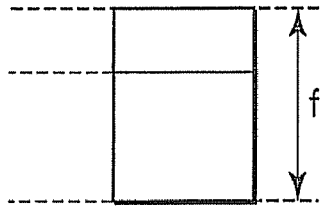
FIG. 10C is a plan view showing the protrusion according to the present embodiment viewed from a rear side.

FIGS. 10A, 10B and 10C is for explaining a structure of protrusions (all protrusions 601*a* to 601*d* and 602*a* to 602*g* have the same shapes) configuring the first and the second protrusions 601 and 602 provided on the lid body 501*c*. Here, in FIGS. 10A, 10B and 10C (hereinafter, similarly in FIGS. 12 and 13), a position X1 is defined as a front surface side of the first toner cartridge 501 and a position Y1 is defined as a rear surface side of the first toner cartridge 501.

FIG. 10A is a plan view showing the protrusion 601*a* viewed from above. FIG. 10B is a cross-sectional view of the protrusion 601*a* cut along the line III-III in FIG. 10A. FIG. 10C is a rear surface view showing the protrusion 601*a* viewed from the position Y1. A bottom surface of the protrusion 601*a* abuts a front surface of the lid body 501*c*, and is provided on a predetermined position on a rear surface side of the first toner cartridge 501.

The protrusion 601*a* has a ramp 800*a* inclining along a direction that the first toner cartridge 501 is inserted in the copier main body 100 (a direction from the position X1 to the position Y1 in FIG. 10 (shown as the X1-Y1 direction)). That is, an edge of the protrusion 601*a*, which is also an edge of the first cartridge 501 in a removing direction, forms the positive ramp 800*a*. The ramp 800*a* of the protrusion 601*a* has a positive angle of inclination with respect to the X1-Y1 direction. An inclination angle $\alpha$ with respect to the lid body 501*c* of the ramp 800*a* is 10 to 45 degrees with respect to the X1-Y1 direction. In the present embodiment, the inclination angle is 29.7 degrees. The ramp 800*a* has a length (e as shown in FIG. 10B) of 3 mm to 5 mm along the X1-Y1 direction.

In addition, the protrusion 601*a* has a protrusion top surface part 800*b* which is the maximum height of the protrusion 601*a*. The protrusion top surface part 800*b* is a surface in a parallel relationship with the lid body 501*c*. The protrusion top surface part 800*b* having the maximum height of the protrusion has a length (d as shown in FIG. 10B) of 1 mm to 3 mm along the X1-Y1 direction. In the present embodiment, the length is 1.5 mm. In addition, the protrusion top surface part 800*b* which is the maximum height of the protrusion 601*a* is formed to have height (f as shown in FIG. 10C) of 1.5 mm to 3 mm from the lid body 501*c*.

Further, the protrusion 601*a* is configured with surfaces of a protrusion curved surface part 800*c* and a protrusion rear surface part 800*e* placed in this order from an outer edge on a side of the position Y1 of the protrusion top surface part 800*b*. The protrusion rear surface part 800*e* is in a perpendicular relationship with respect to a surface of the lid body 501*c* of the first toner cartridge 501. The protrusion curved surface part 800*c* is formed as a chamfer so as to have a gently curved surface between the protrusion top surface part 800*b* and the protrusion rear surface part 800*e*. In the present embodiment, the protrusion curved surface part 800*c* is formed with a curvature R 0.5.

Next, a state in which the user inserts in error in a slot the second toner cartridge 502, the third toner cartridge 503, or the fourth toner cartridge 504, which are for any of the colors other than yellow, will be described, the slot in which the protrusion 505*a* of the cartridge holding mechanism 505 is formed (the slot in which the first toner cartridge 501 of yellow should be inserted).

Figure 11:
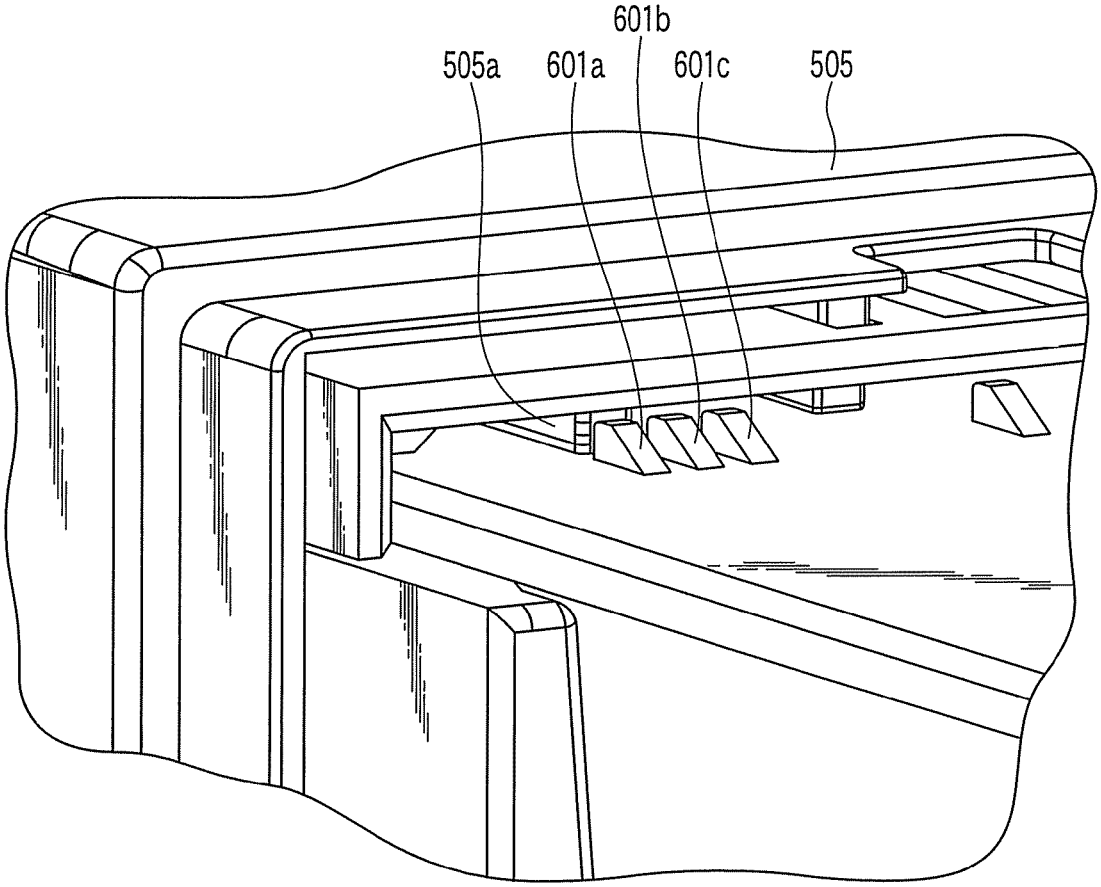
FIG. 11 is a plan view showing the protrusion according to the present embodiment viewed from above.
Figure 12:
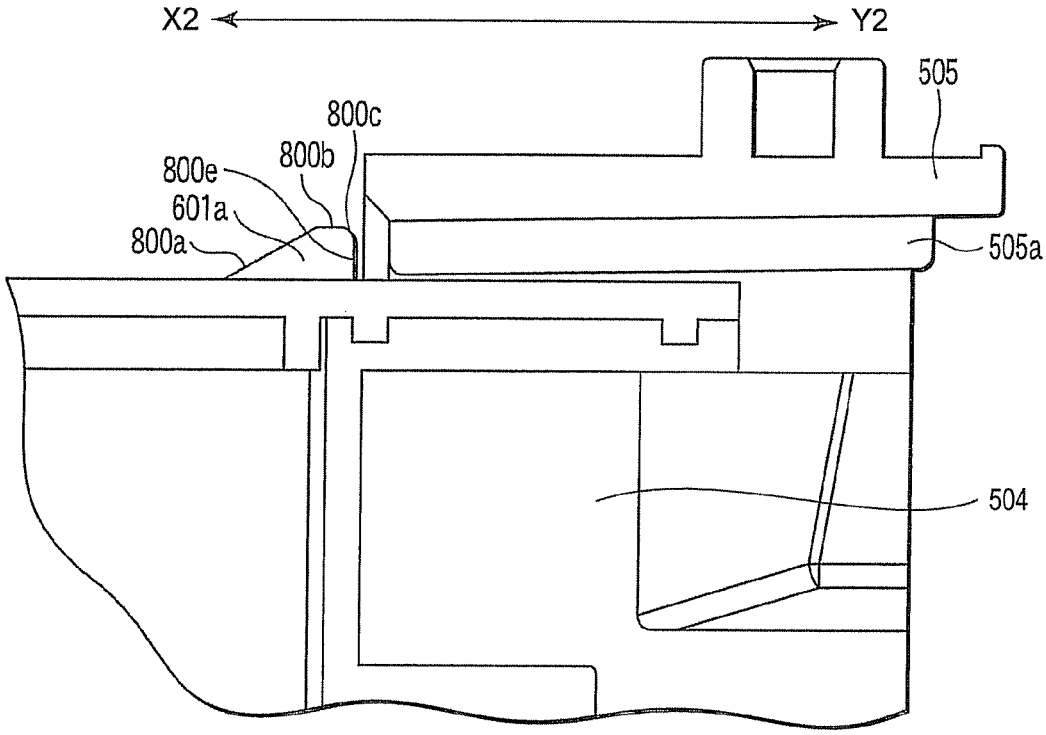
FIG. 12 is a cross-sectional view showing the toner cartridge and the cartridge holding mechanism according to the present embodiment.
Figure 13:
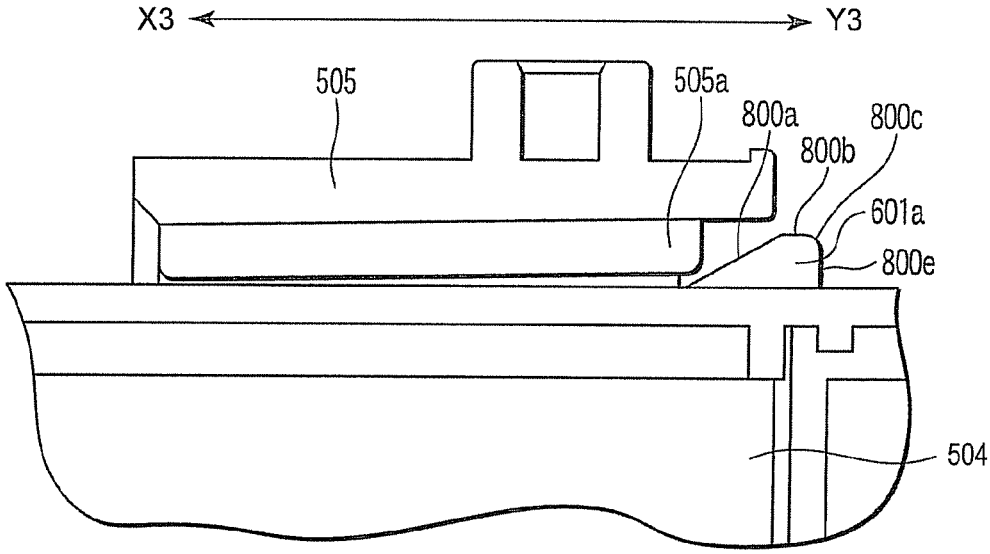
FIG. 13 is a cross-sectional view showing the toner cartridge and the cartridge holding mechanism according to the present embodiment.

Here, FIGS. 11 to 13 are used to describe a case where, for example, the fourth cartridge 504 of black is inserted into the slot in which the protrusion 505*a* of the cartridge holding mechanism 505 is formed. FIG. 11 is a perspective view showing a state in which the protrusion 601*a* of the fourth toner cartridge 504 faces and abuts the protrusion 505*a* of the cartridge holding mechanism 505, the state viewed from above a front surface side. FIG. 12 is a cross-sectional view of the state in FIG. 11 cut along a longitudinal direction of the fourth toner cartridge 504. FIG. 13 shows a state in which the fourth toner cartridge 504 is inserted further from the state shown in FIG. 12 in such a manner that the protrusion 505*a* of the cartridge holding mechanism 505 is pressed aside.

In the case of the fourth toner cartridge 504 of black, the protrusion 601*d* is removed from the first discriminating protrusion unit 601 in FIGS. 6, 7A, 7B and 7C, and the protrusions 601*a*, 601*b*, and 601*c* exist. The second discriminating protrusion unit 602 has the same shape as the one described above. For this reason, when the fourth toner cartridge 504 of black attempts to be inserted into the copier main body 100, the protrusion 505*a* and the protrusion 601*a* come into contact with each other as shown in FIGS. 11 and 12. In addition, as shown in FIG. 12, the protrusion 601*a* abuts the protrusion rear surface part 800*e* of the protrusion 601*a*. Thereby, the insertion of the fourth toner cartridge 504 into the copier main body 100 is interfered.

Here, in recent years, in response to a request for space saving of the image forming apparatus 1, a method of providing the paper delivering unit 600 (refer to FIG. 1) for delivering printed paper to the inside of the image forming apparatus 1 is increasingly adopted. When such a layout is adopted, the paper delivering unit 600 is provided immediately above the cartridge holding mechanism 505 in which the first to the fourth toner cartridges 501 to 504 are inserted. For this reason, a surface of the cartridge holding mechanism 505 on which the protrusions 505*a*, 505*b*, 505*c* and 505*d* exist is difficult to strengthen and easily bent.

For the above reason, the user may insert the protrusion 601*a* of the fourth toner cartridge 504 more closer to a rear surface side (Y3 side) of the image forming apparatus 1 than the protrusion 505*a* of the cartridge holding mechanism 505. When the fourth toner cartridge 504 which is inserted by the user in error is pulled out along a removing direction from Y3 to X3 in FIG. 13, the user can pull out the fourth toner cartridge 504 without need of exerting force. This is because the ramp 800*a* of the protrusion 601*a* has a positive angle of inclination with respect to the X-Y direction (e.g., X1-Y1 direction, X2-Y2 direction, or X3-Y3 direction), and a load applied on the cartridge holding mechanism 505 is reduced.

The protrusion 601*a* is configured with a gentle surface including the protrusion top surface part 800*b* in a parallel relationship with the lid body 501*c*, the protrusion curved surface part 800*c*, and the protrusion rear surface part 800*e*. For this reason, the user can prevent hurting himself or herself by touching the protrusion 601*a* during operation of exchanging the first to the fourth toner cartridges 501 to 504.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge used for an image forming apparatus by being inserted into the image forming apparatus comprising:

a toner container that contains toner; and a protrusion to show a type of the toner cartridge which is formed on a surface of the toner cartridge and includes a maximum height part haying a maximum height of the protrusion, a ramp formed backside of the maximum height part along a direction the toner cartridge is inserted into the image forming apparatus and inclining with a predetermined angle with respect to the surface of the toner cartridge, and an edge surface part formed in front of the maximum height part along the direction the toner cartridge is inserted into the image forming apparatus and being in a perpendicular relationship with respect to the surface of the toner cartridge.

2. The toner cartridge according to claim 1, wherein the ramp of the protrusion has an angle of inclination of 10 to 45 degrees with respect to the direction the toner cartridge is inserted in the image forming apparatus.

3. The toner cartridge according to claim 1, wherein the maximum height part has a length of 1 mm to 3 mm along the direction the toner cartridge is inserted in the image forming apparatus.

4. The toner cartridge according to claim 1, wherein the maximum height part is a surface in a parallel relationship with the surface of the toner cartridge on which the protrusion is formed.

5. The toner cartridge according to claim 1 wherein the ramp has a length of 3 mm to 5 mm along the direction the toner cartridge is inserted in the image forming apparatus.

6. The toner cartridge according to claim 1, wherein a maximum height of the protrusion is 1.5 mm to 3 mm.

7. The toner cartridge according to claim 1, wherein the protrusion includes a plurality of protrusions provided along a direction perpendicular to the direction the toner cartridge is inserted in the image forming apparatus.

8. The toner cartridge according to claim 1, wherein the protrusion to show a type of the toner cartridge includes a first protrusion showing a type of the toner housed in the toner cartridge.

9. A toner cartridge used for an image forming apparatus by inserting the toner cartridge into the image forming apparatus comprising:

a toner container that contains toner; and a protrusion to show a type of the toner cartridge, the protrusion having a ramp inclining along a direction the toner cartridge is inserted in the image forming apparatus and the protrusion including a protrusion member to show a type of the image forming apparatus into which the toner cartridge is inserted.

10. The toner cartridge according to claim 1, wherein the protrusion is on an uppermost surface of the toner container, and is formed near one edge part of the toner cartridge toward the direction the toner cartridge is inserted in the image forming apparatus.

11. A toner cartridge used for an image forming apparatus by being inserted into the image forming apparatus comprising:

a contain means for containing toner; and a type showing means for showing a type of the toner cartridge which is formed on a surface of the toner cartridge and includes a maximum height part having a maximum height of the type showing means, a ramp formed backside of the maximum height part along a direction the toner cartridge is inserted into the image forming apparatus and inclining with a predetermined angle with respect to the surface of the toner cartridge, and an edge surface part formed in front of the maximum height part along the direction the toner cartridge is inserted into the image forming apparatus and being in a perpendicular relationship with respect to the surface of the toner cartridge.

12. The toner cartridge according to claim 11, wherein the ramp of the type showing means has an angle of inclination of 10 to 45 degrees with respect to the direction the toner cartridge is inserted in the image forming apparatus.

13. The toner cartridge according to claim 11, wherein the type showing means includes a plurality of protrusions provided along a direction perpendicular to the direction the toner cartridge is inserted in the image forming apparatus.

14. The toner cartridge according to claim 11, wherein the type showing means is on an uppermost surface of the contain means, and is formed near one edge part of the toner cartridge toward a direction the toner cartridge is inserted in the image forming apparatus.

15. An image forming apparatus, which has a toner cartridge inserted therein comprising:

a toner container that contains toner;

a protrusion to show a type of the toner cartridge which is formed on a surface of the toner cartridge and includes a maximum height part having a maximum height of the protrusion, a ramp formed backside of the maximum height part along a direction the toner cartridge is inserted into the image forming apparatus and inclining with a predetermined angle with respect to the surface of the toner cartridge, and an edge surface part formed in front of the maximum height part along the direction the toner cartridge is inserted into the image forming apparatus and being in a perpendicular relationship with respect to the surface of the toner cartridge;

a slot that inserted the toner cartridge;

a stopper that is provided in the slot and faces the protrusion when the toner cartridge is inserted to the slot except for a designed toner cartridge for inserting to a designed slot.

16. The image forming apparatus according to claim 15, wherein the protrusion includes a plurality of protrusions provided along a direction perpendicular to the direction the toner cartridge is inserted in the image forming apparatus and the stopper faces at least one of the plurality of protrusions when the toner cartridge is inserted to the slot except for the designed toner cartridge for inserting to the designed slot.

17. The image forming apparatus according to claim 15, wherein the protrusion is on an uppermost surface of the toner container, and is formed near one edge part of the toner cartridge toward a direction the toner cartridge is inserted in the image forming apparatus.

18. The image forming apparatus according to claim 15, wherein the stopper is provided in a front surface side of the image forming apparatus.

* * * * *